US011085357B2

(12) United States Patent
Richter et al.

(10) Patent No.: US 11,085,357 B2
(45) Date of Patent: Aug. 10, 2021

(54) METHOD AND DEVICE FOR VENTILATING A HEAT MANAGEMENT SYSTEM OF AN INTERNAL COMBUSTION ENGINE

(71) Applicant: Bayerische Motoren Werke Aktiengesellschaft, Munich (DE)

(72) Inventors: Rainer Richter, Munich (DE); Wolfgang Hofmann, Otterfing (DE); Wolfram Enke, Meissen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 155 days.

(21) Appl. No.: 15/217,708

(22) Filed: Jul. 22, 2016

(65) Prior Publication Data

US 2017/0030252 A1 Feb. 2, 2017

Related U.S. Application Data

(63) Continuation of application No. PCT/EP2015/050673, filed on Jan. 15, 2015.

(30) Foreign Application Priority Data

Jan. 23, 2014 (DE) ..... 10 2014 201 170.1

(51) Int. Cl.

| | |
|---|---|
| ***F01P 11/02*** | (2006.01) |
| ***F01P 7/14*** | (2006.01) |
| ***F01P 11/04*** | (2006.01) |

(52) U.S. Cl.

CPC ..... *F01P 11/0285* (2013.01); *F01P 7/14* (2013.01); *F01P 11/028* (2013.01); (Continued)

(58) Field of Classification Search

CPC ..... F01P 11/0285; F01P 11/028; F01P 2007/146; F01P 7/167; F01P 11/29; (Continued)

(56) References Cited

U.S. PATENT DOCUMENTS 3,948,226 A * 4/1976 Green ..... F01C 9/00 123/18 R
4,224,906 A * 9/1980 Happel ..... F02D 21/08 123/568.14

(Continued)

FOREIGN PATENT DOCUMENTS

CN 101968401 A 2/2011
CN 102182538 A 9/2011

(Continued)

OTHER PUBLICATIONS

DE102004058865A1 English Machine Translation—Retrieved Jan. 2018.*

(Continued)

*Primary Examiner* — Len Tran
*Assistant Examiner* — Jenna M Hopkins
(74) *Attorney, Agent, or Firm* — Crowell & Moring LLP

(57) ABSTRACT

To ventilate a heat management system of an internal combustion engine, in which coolants circulate in several coolant circuits, connected inlets of a rotary valve may be opened and closed in a predetermined sequence, in order to ventilate one or more of the coolant circuits in the direction of the compensation tank, by means of at least one ventilation circuit which is in fluid connection with a coolant compensation tank. The rotary valve may be controlled by means of a control unit, wherein a non-connected inlet of the rotary valve is in fluid connection with the coolant compensation tank.

14 Claims, 2 Drawing Sheets

(52) U.S. Cl.
CPC ..... *F01P 11/029* (2013.01); *F01P 11/04* (2013.01); *F01P 2007/146* (2013.01)

(58) Field of Classification Search
CPC .. F01P 2031/00; F16K 31/041; F16K 31/523; F16K 31/528; F16K 27/0263; F16K 5/10
USPC ..... 123/41.02; 165/200
See application file for complete search history.

(56) References Cited

U.S. PATENT DOCUMENTS 4,319,547 A * 3/1982 Bierling ..... F01P 7/165 123/41.08
4,913,107 A * 4/1990 Schweiger ..... F01P 11/0247 123/41.1
5,415,147 A * 5/1995 Nagle ..... F01P 3/20 123/41.29
5,617,815 A * 4/1997 Spies ..... F16K 11/076 123/41.1
6,047,895 A * 4/2000 Pastleitner ..... F01P 3/02 236/34.5
6,196,167 B1 * 3/2001 Marsh ..... F01P 7/14 123/41.09
6,539,899 B1 * 4/2003 Piccirilli ..... F01P 7/167 123/41.08
6,994,316 B2 * 2/2006 Pervaiz ..... F16K 5/0478 251/160
7,424,869 B2 * 9/2008 Haase ..... F01P 7/16 123/41.1
7,984,700 B2 * 7/2011 Chanfreau ..... B60H 1/00485 123/41.08
8,181,610 B2 * 5/2012 Dipaola ..... F01P 7/165 123/41.1
8,347,831 B2 * 1/2013 Vacca ..... F16K 11/085 123/41.08
8,555,825 B2 * 10/2013 Lenz ..... F01P 3/02 123/41.79
8,800,503 B2 * 8/2014 Bohm ..... F01P 7/165 123/188.9
8,851,026 B2 * 10/2014 Brinkmann ..... F01P 11/0285 123/41.02
8,863,704 B2 * 10/2014 Mehring ..... F02F 1/10 123/41.82 R
8,909,398 B2 * 12/2014 Sawada ..... B60K 11/02 165/200
10,211,493 B2 * 2/2019 Janarthanam ..... B60L 1/003
10,364,737 B2 * 7/2019 Roehm ..... F01P 11/029
2003/0079728 A1 * 5/2003 Marsh ..... F01P 3/20 123/563
2003/0098077 A1 * 5/2003 McLane ..... F16K 11/0856 137/625.47
2004/0216700 A1 * 11/2004 Hutchins ..... B60H 1/00314 123/41.08
2005/0006487 A1 * 1/2005 Suda ..... G05D 23/1951 236/46 R
2006/0157000 A1 * 7/2006 Lutze ..... F01P 3/20 123/41.02
2007/0175442 A1 * 8/2007 Vichinsky ..... F02D 11/06 123/336
2008/0035080 A1 * 2/2008 Haase ..... F01P 7/16 123/41.1
2008/0236193 A1 * 10/2008 Chen ..... F25B 5/00 62/511
2009/0211247 A1 * 8/2009 McEwan ..... F01N 11/002 60/602
2009/0308335 A1 * 12/2009 Dipaola ..... F01P 7/16 123/41.1
2010/0100266 A1 * 4/2010 Yoshinori ..... B60L 58/27 701/22
2011/0272049 A1 * 11/2011 Jorgensen ..... F16K 11/0856 137/625.47
2012/0227580 A1 * 9/2012 Dudar ..... G01M 3/04 95/19
2012/0234266 A1 * 9/2012 Faulkner ..... F01P 7/165 123/41.1
2013/0167786 A1 * 7/2013 Mehring ..... F01P 3/02 123/41.82 R
2013/0186351 A1 * 7/2013 Quix ..... F01P 3/02 123/41.02
2014/0144134 A1 * 5/2014 McEwan ..... F02B 37/183 60/602
2014/0225426 A1 * 8/2014 Dabbs ..... B60T 13/141 303/10
2015/0047340 A1 * 2/2015 Ulrey ..... F02D 41/0047 60/600
2015/0101693 A1 * 4/2015 Enomoto ..... F16K 27/003 137/597
2015/0217622 A1 * 8/2015 Enomoto ..... B60L 1/003 165/42
2016/0109890 A1 * 4/2016 Styron ..... F01P 7/16 236/34.5
2016/0153573 A1 * 6/2016 Atschreiter ..... F16K 17/386 137/467
2016/0215680 A1 * 7/2016 Quix ..... F01P 3/02
2016/0251998 A1 * 9/2016 Ekman ..... F01P 3/12 165/51
2016/0325601 A1 * 11/2016 Richter ..... F01P 11/08
2017/0159548 A1 * 6/2017 Richter ..... F02D 31/001
2018/0119827 A1 * 5/2018 Ozeki ..... F16K 31/041
2019/0234290 A1 * 8/2019 Justel ..... F01P 3/02

FOREIGN PATENT DOCUMENTS

CN 102705055 A 10/2012
CN 203081557 U 7/2013
CN 103321735 A 9/2013
DE 37 16 555 A1 12/1988
DE 0972916 A2 * 1/2000 ..... B60T 1/087
DE 10 2004 058 865 A1 6/2006
DE 102004058865 A1 * 6/2006 ..... F01P 7/16
DE 602 09 019 T2 8/2006
DE 10 2005 010 236 A1 9/2006
DE WO 2006094636 A1 * 9/2006 ..... F01P 7/16
DE WO 2009143866 A1 * 12/2009 ..... F01P 3/02
DE 10 2010 017 766 A1 1/2012
DE 102011003430 B3 * 5/2012 ..... F01P 7/167
DE 102012210320 B3 * 9/2013 ..... F01P 7/14
DE 102012210320 B3 * 9/2013 ..... F01P 7/14
EP 0972916 A2 * 1/2000 ..... B60T 1/087
SE WO 2008080872 A1 * 7/2008 ..... F01P 7/165
WO WO 2005/082653 A1 9/2005
WO WO-2006094636 A1 * 9/2006 ..... F01P 7/16
WO WO-2009143866 A1 * 12/2009 ..... F01P 3/02

OTHER PUBLICATIONS

PCT/EP2015/050673, International Search Report dated Apr. 8, 2015 (Two (2) pages).
German Search Report issued in German counterpart application No. 10 2014 201 170.1 dated Mar. 27, 2014, with Statement of Relevancy (Six (6) pages).
Chinese Office Action issued in Chinese counterpart application No. 201580002638.1 dated Oct. 9, 2017, with English translation (Thirteen (13) pages).

* cited by examiner

METHOD AND DEVICE FOR VENTILATING A HEAT MANAGEMENT SYSTEM OF AN INTERNAL COMBUSTION ENGINE

CROSS REFERENCE TO RELATED APPLICATIONS

This application is a continuation of PCT International Application No. PCT/EP2015/050673, filed Jan. 15, 2015, which claims priority under 35 U.S.C. § 119 from German Patent Application No. 10 2014 201 170.1, filed Jan. 23, 2014, the entire disclosures of which are herein expressly incorporated by reference.

BACKGROUND AND SUMMARY OF THE INVENTION

The invention relates to a method and to a device for the ventilation of a heat management system of an internal combustion engine.

Heat management systems of modern internal combustion engines are composed of a large number of different sub-circuits in which coolant circulates. During a replenishment of coolant, or else as a result of repair work, a situation may arise in which air ingresses into the system and into the coolant lines. For correct operation of the system, the air must be discharged.

It is an object of the invention to provide a simple means for the ventilation of a heat management system.

According to one aspect of the invention, this is achieved by way of a method for the ventilation of a heat management system of an internal combustion engine, in which coolant circulates in multiple coolant circuits, wherein switched inlets of a rotary slide valve are opened and closed in a predefined sequence in order to ventilate one or more of the coolant circuits in the direction of a coolant expansion tank via at least one ventilation line which is connected in terms of flow to the expansion tank.

In a known manner, the coolant expansion tank is in contact with the surroundings of the internal combustion engine, such that the air can escape from the system. Through the targeted switching of the rotary slide valve, and thus the targeted opening and closing of individual coolant sub-circuits, the air that is enclosed in the coolant lines is, with the coolant flow, transported in targeted fashion in the direction of the one or more ventilation lines, and forced via said ventilation lines into the expansion tank. The sequence of the opening and closing of the inlets and outlets of the rotary slide valve can be coordinated with the circumstances of the heat management system, and is independent of the operating positions of the rotary slide valve during the rest of the operation of the internal combustion engine.

It is preferably the case that, during the ventilation process, the internal combustion engine is idle, such that, even in the case of a mechanically driven coolant pump being used, the heat management system can be ventilated without the connection of an additional pump. It is also possible for the internal combustion engine to be operated, in short intervals, with an increased engine speed. Another possibility is to raise the idle engine speed for the duration of the ventilation program.

In the executed sequence of the opening and closing of the inlets of the rotary slide valve, it is for example possible for the individual inlets of the rotary slide valve to be briefly opened, such that a pulsed coolant flow can be generated in particular coolant lines of the system.

It is also possible for in each case only a single one of the coolant circuits to be opened and ventilated in targeted fashion.

The control sequence for the switching of the rotary slide valve is preferably stored in the control unit. It is self-evidently possible for multiple control sequences to be provided which are used for the ventilation of particular coolant circuits and/or in particular situations.

The ventilation method is preferably executed only during maintenance, for example during the course of a workshop visit, and in a particular ventilation mode of the control unit. It is, however, also possible for the ventilation method to also be executed during vehicle operation, if required, in order to keep sub-circuits permanently air-free.

A device according to the invention for the ventilation of a heat management system of an internal combustion engine comprises a coolant expansion tank and comprises a control unit which controls a rotary slide valve which has switched inlets which are connected in terms of flow to an engine cooling circuit and to a main cooler circuit, wherein at least one of the coolant circuits is connected to the coolant expansion tank via a ventilation line. The coolant expansion tank is preferably connected to a non-switched inlet of the rotary slide valve. In this way, by way of the connection of the coolant expansion tank directly to the rotary slide valve, and via the ventilation line, air that is present in the coolant lines of the cooling circuits can be targetedly moved in the direction of the coolant expansion tank through targeted specification of a sequence of switching positions of the rotary slide valve.

A heating circuit and/or a bearing seat cooling arrangement of an exhaust-gas turbocharger may also be connected in terms of flow to the ventilation device.

The rotary slide valve may preferably also assume intermediate positions in which multiple sub-circuits are simultaneously entirely or partially opened.

It is possible for the connecting line to the coolant expansion tank to issue into the same inlet of the rotary slide valve as a return line of an exhaust-gas turbocharger cooling circuit or of a transmission oil cooling circuit, said inlet preferably being of non-switched design. In this way, there is no need to provide a dedicated inlet for the coolant expansion tank on the rotary slide valve, which makes the manufacture of said rotary slide valve cheaper, and reduces the structural space of said rotary slide valve.

The invention will be described in more detail below on the basis of two exemplary embodiments and with reference to the appended drawings, in which:

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
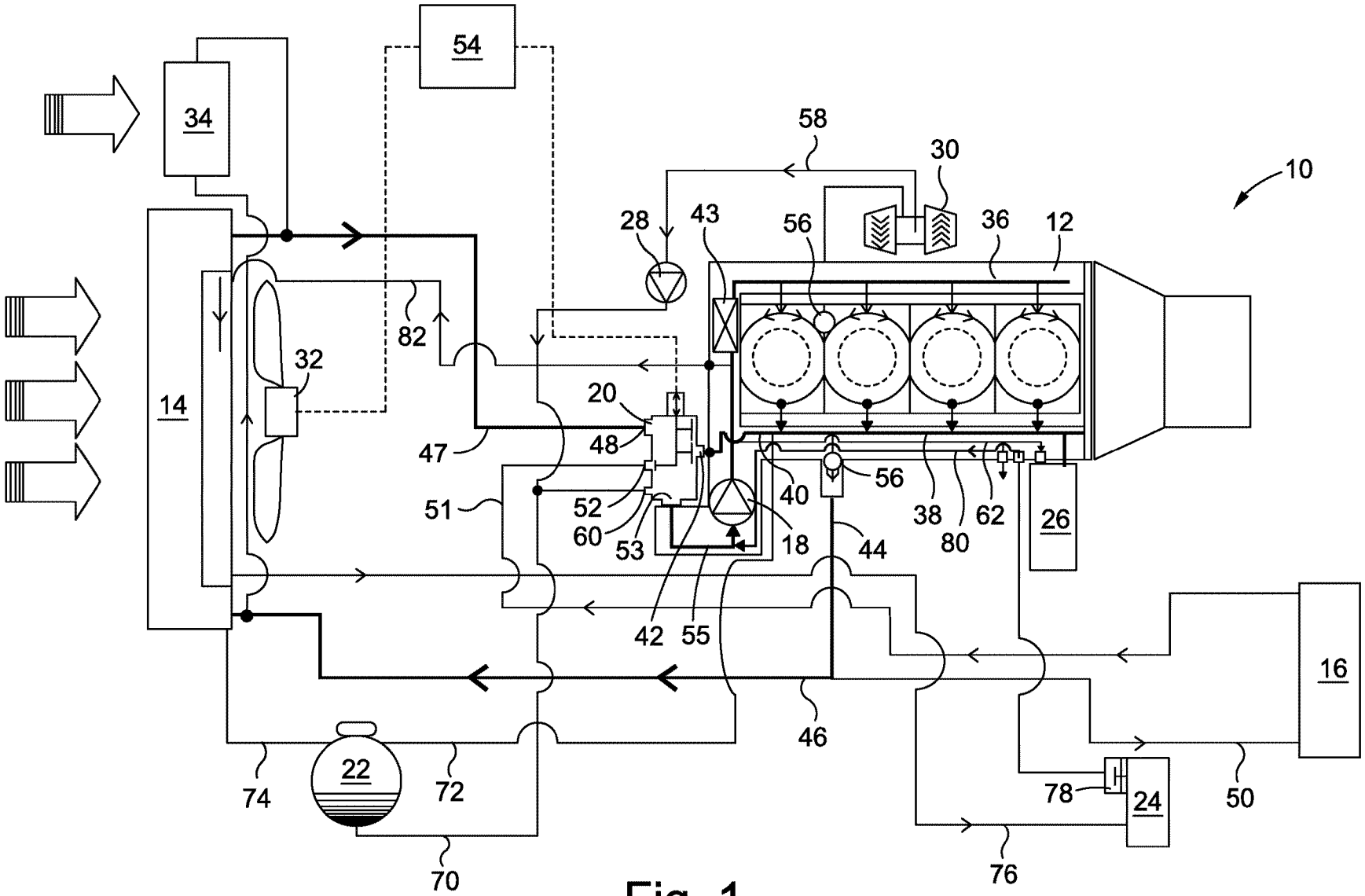
FIG. 1 shows a schematic view of a heat management system in a first variant, having a device for carrying out a ventilation method according to the invention.

FIG. 1 shows a heat management system 10 for an internal combustion engine 12 (in this case an in-line four-cylinder Otto-cycle engine).

Coolant flows, in multiple coolant circuits, inter alia through an engine block of the internal combustion engine 12, through an air-cooled main cooler 14, and through a heating heat exchanger 16. The coolant is moved primarily by way of a coolant pump 18, which in this case is mechanically driven.

The coolant flows are controlled by way of a rotary slide valve 20, the inlets of which are connected to the return lines of the coolant circuits, and the outlet of which is directly connected in terms of flow to the coolant pump 18, as will be described in detail further below.

Also provided are a coolant expansion tank 22, a transmission oil heat exchanger 24, an engine oil heat exchanger 26, and an additional, electrically operated coolant pump 28, wherein the latter is fluidically connected to a heat exchanger (housing cooling) of an exhaust-gas turbocharger 30. The electrically driven additional coolant pump 28 has a power of approximately 20-150 W, in this example.

The main cooler 14 is assisted by way of a fan 32. Furthermore, an additional cooler 34 is provided for assisting the main cooler, which additional cooler may for example be formed as a cooler mounted in a wheel arch.

In an engine cooling circuit 36 (also referred to as "small cooling circuit"), cold coolant is transported by the coolant pump 18 to an engine block of the internal combustion engine 12, more precisely to cooling ducts in the cylinder head housing and in the crankcase, where said coolant absorbs waste heat, before being collected in a line 38. A bypass line 40 leads from the collecting line 38 to a first switched inlet 42 of the rotary slide valve 20. The bypass line 40 also forms the return line of the engine cooling circuit 36.

Here, the engine cooling circuit 36 can be shut off, with regard to its conducting of coolant, downstream of the coolant pump 18 by an engine shut-off valve 43.

From the collecting line 38 there branches off a coolant line 44 which is part of a main cooler circuit 46 which leads back, through the main cooler 14 and via a return line 47, to a switched second inlet 48 of the rotary slide valve 20.

From the line 44 there branches off a feed line to a heating circuit 50, in which the heating heat exchanger 16 is arranged, which can release heat to a vehicle interior compartment. The return line 51 of the heating circuit 50 leads to a third switched inlet 52 of the rotary slide valve 20.

A single, non-switched outlet 53 of the rotary slide valve 20 leads via a short line 55 to the coolant pump 18.

The position of the one or more rotary slides of the rotary slide valve 20, and thus the degree of opening of the switched inlets 42, 48, 52, is predefined by a control unit 54, which may form part of an engine electronics unit. In the control unit 54 there are stored data which permit characteristic map-based control in a manner dependent on predefined operating states of the internal combustion engine 12. In this example, the states of further components, such as the heating heat exchanger 16, the exhaust-gas turbocharger 30 and the engine oil heat exchanger 26, and data from temperature sensors 56 in the engine block or in the coolant line 44 to the main cooler 14, are also taken into consideration. The position of the switched inlets of the rotary slide valve 20 is defined in a manner dependent on said parameters.

The additional electric coolant pump 28 is situated in an exhaust-gas turbocharger cooling circuit 58, which cools the exhaust-gas turbocharger 30 and which issues into a non-switched inlet 60 of the rotary slide valve 20. A supply is provided to the exhaust-gas turbocharger cooling circuit 58 from the engine cooling circuit 36 by way of a branch (not shown in any more detail here).

The engine oil heat exchanger 26 is connected directly to the collecting line 38 of the engine cooling circuit 36. Cold coolant is supplied by way of a branch 62 downstream of the coolant pump 18. In this example, a controller is not provided but could be realized by way of an additional thermostat.

The coolant expansion tank 22 leads via a connecting line 70 to the return line of the exhaust-gas turbocharger cooling circuit 58, which issues into the non-switched inlet 60 of the rotary slide valve 20. Ventilation lines 72 and 74 connect the coolant expansion tank 22 to the engine cooling circuit 36, more specifically to the collecting line 38 and to the feed line to the main cooler 14 in the main cooler circuit 46. The transmission oil heat exchanger 24 is situated in a transmission oil cooling circuit 76 which is independent of the rotary slide valve 20, and said transmission oil heat exchanger is switched by way of a dedicated thermostat valve 78. The latter is in this case a conventional wax thermostat which opens the transmission oil cooling circuit 76 in the presence of a predetermined temperature, and closes said transmission oil cooling circuit below said temperature.

The transmission oil cooling circuit 76 leads through the engine block into a feed line 80, which issues into the short line 55. The issuing-in point lies upstream of the coolant pump 18 but downstream of the outlet 53 of the rotary slide valve 20. A line 82 branches off from the engine cooling circuit 36 between the coolant pump 18 and the engine shut-off valve 43, said line leading through the main cooler 14 and back to the transmission oil heat exchanger 24 (low-temperature loop). This is required only in the case of vehicles with transmission cooling.

The coolant pump 18 is in this case directly integrated into the engine block of the internal combustion engine 12. In this embodiment, the rotary slide valve 20 is mounted on the end side of the engine block of the internal combustion engine 12, in the immediate vicinity of the coolant pump 18.

If the inlet 48 of the rotary slide valve 20 is closed by the control unit 54, the coolant flow through the main cooler 14 in the main cooler circuit 46 is stopped. This state is assumed in particular upon starting of the internal combustion engine 12 and in part-load operation.

If the inlet 42 of the rotary slide valve 20 is open, the coolant flows via the bypass line 40 from the hot side of the internal combustion engine 12 directly into the rotary slide valve 20, and is recirculated from there directly to the cold side of the internal combustion engine 12 by way of the coolant pump 18.

If the inlet 52 of the rotary slide valve 20 is switched so as to be open, it is furthermore the case that coolant flows through the heating circuit 50 via the heating heat exchanger 16.

The switching of the inlets 42 and 52 makes it possible to realize multiple operating states. If both the inlet 42 and the inlet 52 are open, the engine cooling circuit 36 and the heating circuit 50 are flowed through in parallel. Here, the flow conditions are selected such that a considerably greater volume flow passes through the engine cooling circuit 36 than through the heating circuit 50, as is known. In this operating state, it is for example possible for the internal combustion engine 12 to warm up to its operating temperature, with the vehicle interior compartment simultaneously being heated.

If the inlet 42 is completely or partially closed, the flow through the engine cooling circuit 36 is reduced, such that the load on the coolant pump 18 is reduced. By way of the open heating circuit 50, heat can be released, and a targeted circulation of the coolant can be maintained. Owing to the relatively high flow resistance, the coolant volume flow through the internal combustion engine 12 is reduced. This can be utilized for a faster warm-up upon a cold start.

If the inlet 52 is switched so as to be entirely or partially closed, the heating circuit 50 is decoupled and flow does not pass through it. This is the case firstly when no heating function is desired, that is to say the vehicle occupants have switched off the heater.

Another usage case is a driving situation in which the load of the internal combustion engine 12 suddenly increases, for example when ascending a hill or upon an abrupt onset of acceleration. In this case, the closing of the heating circuit 50 in combination with the opening of the inlet 42 of the engine cooling circuit 36, and possibly of the inlet 48 of the main cooler circuit 46, has the effect that the entire coolant flow is available for the cooling of the internal combustion engine 12, such that temperature peaks are avoided.

In the warm-up phase of the internal combustion engine, the inlets 42, 48 and 52 can be closed in order to at least substantially stop a flow of the coolant in the engine cooling circuit 36, too, and thus realize a faster warm-up. To prevent cavitation on the suction side of the coolant pump 18, it is also the case here that the engine shut-off valve 43 is closed.

The activation and deactivation of the main cooler circuit 46 are realized by opening and closing of the inlet 48 of the rotary slide valve 20. This may (in the context of the predefined design of the rotary slide valve 20) take place independently of the opening and shutting-off of the engine cooling circuit 36 and of the heating circuit 50, and furthermore in temperature-independent fashion by way of commands from the control unit 54.

The flow through the engine may in this case be controlled, inter alia in the warm-up and in relevant consumption cycles, and by actuation of the rotary slide valve 20 and of the engine shut-off valve 43, for optimum heat distribution and friction optimization. These functions are also stored in the control unit 54.

The control unit 54 furthermore has a stored ventilation program which comprises an actuation sequence for different positions of the rotary slide valve 20.

Said program may be executed for example for maintenance purposes in a suitably equipped workshop. Here, the internal combustion engine 12 runs at idle. If the normal idle engine speed is not sufficient, the engine speed may be briefly raised, or else the idle engine speed may be raised to a considerably higher level for the duration of the ventilation program.

By way of targeted opening and closing of the individual coolant circuits, for example of the engine cooling circuit 36, of the main cooler circuit 46 and of the heating circuit 50, it is possible in targeted fashion for air that is present in the lines to be transported via the ventilation lines 72, 74 to the expansion tank 22, where the air is separated off.

Said actuation of the switchable inlets 42, 48, 52 of the rotary slide valve 20 is entirely independent of the control of the rotary slide valve in other operating states, and serves merely for the targeted conducting of the coolant through the ventilation lines 72, 74, such that entrained air is separated off in the expansion tank 22.

It may for example be expedient for all of the inlets to be briefly closed at predetermined intervals in order to force the coolant into the ventilation line 72, 74. It is also conceivable for air to be collected in targeted fashion in components and then separated off in the expansion tank 22 by way of defined opening of the sub-circuits.

It is also possible for the individual coolant circuits to be briefly opened and closed again in rapid succession in targeted fashion in order to transfer air from one circuit into the other and thus move said air to the expansion tank 22.

It is likewise possible for in each case only precisely one of the circuits to be operated in targeted fashion and for valves that may be provided on the ventilation lines 72, 74 to be opened and closed in targeted fashion.

The one or more ventilation programs are stored in the control unit 54 and may be executed in a maintenance mode or in an assembly mode, wherein the control sequence is then run through automatically.

Figure 2:
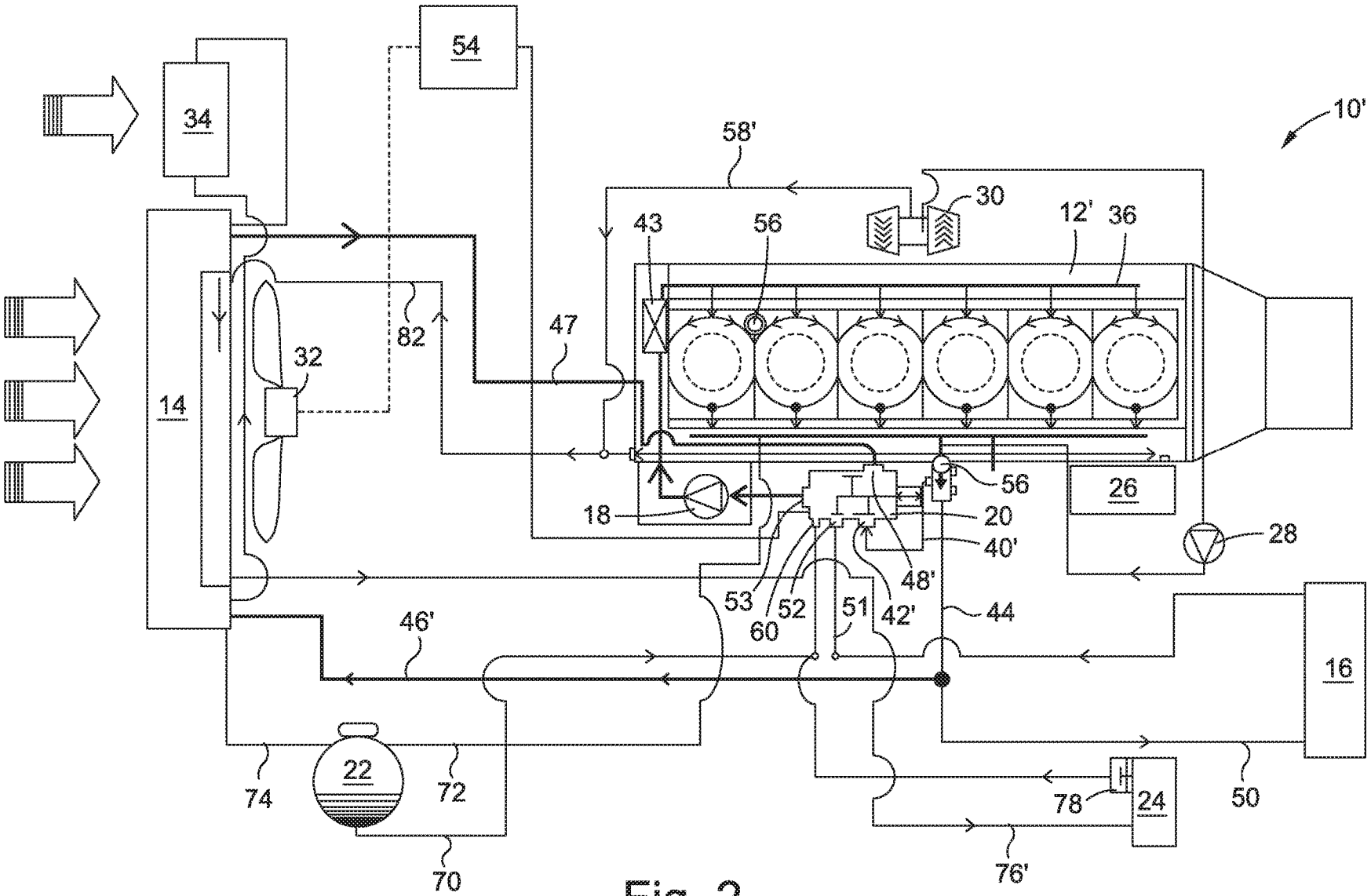
FIG. 2 shows a schematic view of a heat management system in a second variant, having a device for carrying out a ventilation method according to the invention.

FIG. 2 shows a second embodiment of a heat management system 10', wherein for components that have already been introduced, the reference designations already known are used again. Modified but similar components are denoted by the known reference designation with an apostrophe suffix.

By contrast to the embodiment illustrated in FIG. 1, the internal combustion engine 12' is in this case a six-cylinder in-line engine, which, for space reasons, has the effect that the rotary slide valve 20 is arranged not on the face side but along a long side of the engine block of the internal combustion engine 12.

Likewise for space reasons, the return line 47' of the main cooler circuit 46' leads, in part, through the engine block of the internal combustion engine 12' to the switched inlet 48' of the rotary slide valve 20.

In terms of physical arrangement in the rotary slide valve 20, the inlet 42' in the second embodiment corresponds to the inlet 42 in the first embodiment, and vice versa. The function of the rotary slide valve 20 is however analogous to that in the first embodiment.

In this embodiment, the return line of the exhaust-gas turbocharger cooling circuit 58' issues into the line 44 upstream of a branch of the bypass line 40' to the rotary slide valve 20.

The feed line of the exhaust-gas turbocharger cooling circuit 58' branches off, downstream of an outlet from the engine block, from a feed line 82 of the transmission oil cooling circuit 76' to the main cooler 14. As in the first example, the return line of the transmission oil cooling circuit 76' leads from the transmission oil heat exchanger 24 to the non-switched inlet 60 of the rotary slide valve 20.

Here, the connecting line 70 from the coolant expansion tank 22 issues into the return line of the transmission oil cooling circuit 76', which leads to the non-switched inlet 60 of the rotary slide valve 20.

All of the features not described in conjunction with FIG. 2 are identical in terms of construction and function to those described in FIG. 1.

As shown by the two embodiments described above, the principle according to the invention of the use of a rotary slide valve with switched and non-switched inlets for the targeted disconnection of a heating circuit and for the switching of the engine circuit and of the main cooler circuit, but also of the central connection of further cooling circuits such as for example the transmission oil cooling circuit and the exhaust-gas turbocharger cooling circuit, can be easily implemented in a flexible manner for different internal combustion engines. Correspondingly, a person skilled in the art is afforded great freedom in designing heat management systems according to the invention, wherein all of the features of the two embodiments may be combined with one another, or exchanged for one another, as desired.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for the ventilation of a heat management system of an internal combustion engine, in which coolant circulates in multiple coolant circuits, the method comprising the acts of:

sequentially opening and closing switched inlets of a rotary slide valve according to a predefined sequence of opening and closing, the predefined sequence comprising opening and closing the switched inlets so as to targetedly conduct air present in the multiple coolant circuits to a coolant expansion tank via a common ventilation line that fluidically connects a single outlet of the rotary slide valve to the expansion tank, wherein the switched inlets of the rotary slide valve are connected to return lines of the multiple coolant circuits, and wherein the single outlet of the rotary slide valve is further directly connected to a coolant pump of the heat management system.

2. The method as claimed in claim 1, wherein the method further comprises running the internal combustion engine, during the ventilation process, at one of idle and in short intervals with an increased engine speed.

3. The method as claimed in claim 1, wherein the switched inlets of the rotary slide valve are each openable so as to thereby generate a pulsed coolant flow.

4. The method as claimed in claim 2, wherein the switched inlets of the rotary slide valve are each openable so as to thereby generate a pulsed coolant flow.

5. The method as claimed in claim 1, wherein opening and closing switched inlets of the rotary slide valve comprises opening and closing switched inlets of the rotary slide valve such that only one of the one or more multiple coolant circuits is open.

6. The method as claimed in claim 2, wherein opening and closing switched inlets of the rotary slide valve comprises opening and closing switched inlets of the rotary slide valve such that only one of the one or more multiple coolant circuits is open.

7. The method as claimed in claim 3, wherein opening and closing switched inlets of the rotary slide valve comprises opening and closing switched inlets of the rotary slide valve such that only one of the one or more multiple coolant circuits is open.

8. The method as claimed in claim 1, further comprising storing at least one control sequence for the switching of the rotary slide valve in a control unit configured to control the rotary slide valve.

9. A device configured to ventilate a heat management system of an internal combustion engine, the device comprising:

a coolant expansion tank;

a coolant pump configured to move coolant through an engine cooling circuit and a main cooler circuit;

a rotary slide valve having switched inlets fluidically connected to the engine cooling circuit and to the main cooler circuit, and a single outlet fluidically connectable to the expansion tank via a common ventilation line; and a control unit configured to control the rotary slide valve to connect at least one of the engine cooling circuit and the main cooler circuit to the coolant expansion tank via the common ventilation line, wherein the control includes sequentially opening and closing switched inlets of the rotary slide valve according to a predefined sequence of opening and closing, the predefined sequence comprising opening and closing the switched inlets so as to targetedly conduct air present in the multiple coolant circuits to the coolant expansion tank via the common ventilation line, wherein the switched inlets of the rotary slide valve are connected to return lines of the engine cooling circuit and main cooler circuit, and wherein the single outlet of the rotary slide valve is further directly connected to the coolant pump.

10. The device as claimed in claim 9, wherein a non-switched inlet of the rotary slide valve is fluidically connected to the coolant expansion tank.

11. The method of claim 1, wherein the sequentially opening and closing switched inlets of the rotary slide valve according to the predefined sequence is carried out in a ventilation operating mode distinct from cooling or heating operating modes.

12. The device of claim 9, wherein the sequentially opening and closing switched inlets of the rotary slide valve according to the predefined sequence is carried out in a ventilation operating mode distinct from cooling or heating operating modes.

13. The method of claim 1, wherein the common ventilation line conducts coolant solely in a ventilation operating mode distinct from cooling or heating operating modes.

14. The device of claim 9, wherein the common ventilation line conducts coolant solely in a ventilation operating mode distinct from cooling or heating operating modes.

* * * * *